US007533711B2

(12) United States Patent
Ng et al.

(10) Patent No.: US 7,533,711 B2
(45) Date of Patent: May 19, 2009

(54) ROMAN A BLIND ASSEMBLY

(76) Inventors: Philip Ng, 25 White Blvd., Thornhill, Ontario (CA) L4J 5Z4; Xiulian Zhang, 40 Fountainhead Road, Apt. 503, Toronto, Ontario (CA) M3J 2V1; Norman Wills, 1860 Woodhang Way, Mississauga, Ontario (CA) L6N 7T2

( * ) Notice: Subject to any disclaimer, the term of this patent is extended or adjusted under 35 U.S.C. 154(b) by 0 days.

(21) Appl. No.: 11/475,148

(22) Filed: Jun. 27, 2006

(65) Prior Publication Data

US 2007/0000619 A1 Jan. 4, 2007

Related U.S. Application Data

(60) Provisional application No. 60/695,010, filed on Jun. 30, 2005.

(51) Int. Cl.
*A47H 5/00* (2006.01)
*E06B 3/48* (2006.01)

(52) U.S. Cl. ..... 160/84.01

(58) Field of Classification Search ..... 160/84.01, 160/84.04, 84.05, 84.06; 289/1.2, 1.5, 3; 24/265 AL; 87/13

See application file for complete search history.

(56) References Cited

U.S. PATENT DOCUMENTS 5,970,697 A * 10/1999 Jacobs et al. ..... 57/22
2004/0231805 A1* 11/2004 Sudano ..... 160/89
2006/0086467 A1* 4/2006 Yu et al. ..... 160/84.04

* cited by examiner

*Primary Examiner*—Katherine W Mitchell
*Assistant Examiner*—Jeremy C Ramsey
(74) *Attorney, Agent, or Firm*—Elias Borges

(57) ABSTRACT

The present invention is a method of attaching a ring member to a cord using a minimum of steps. The method includes the steps of providing a hobble cord having opposite first and second ends and a plurality of loops. The loops of the cord are preferably preformed onto the cord and are integral thereto. Each loop formed on the cord has a loop opening dimensioned to receive one end of the cord. The first end of the cord is first threaded through the ring and the ring is then positioned to sit adjacent one of the loops between the loop and the first end of the hobble cord. The first end of the hobble cord is then threaded through the opening of the loop. The ring is then firmly secured to the cord by pulling the cord all the way through the loop. The steps may be repeated to attach more rings to the cord in succession.

2 Claims, 11 Drawing Sheets

ROMAN A BLIND ASSEMBLY

CROSS REFERENCE TO RELATED APPLICATION

The present application claims the benefit of U.S. provisional patent application Ser. No. 60/695,010 filed Jun. 30, 2005, the entirety of which is incorporated herein by reference.

FIELD OF THE INVENTION

The invention relates generally to assemblies for constructing blinds.

BACKGROUND OF THE INVENTION

Roman blinds are a common and popular type of blind. The roman blind generally consists of a substantially flat sheet of fabric which is mounted to a plurality of parallel horizontal bars suspended from at least one pair of suspension cords. The fabric is arranged in a series of horizontal folds with the bars providing structural support for the folds of fabric. The suspension cords are suspended from a head assembly, which controls the lifting and lowering of the suspension cords. Lifting or lowering the suspension cords causes the bars to lift and lower, thereby drawing up the fabric screen or lowering it.

Mounting the suspension bars to the fabric screen and to the suspension cords is an important and often time consuming step in assembling roman blinds. Traditionally, the suspension bars were contained in sleeves sewn into the fabric screen. More recently, designs have been introduced which include a bracket for mounting the suspension bars to the fabric screen. While mounting the roman bars to the fabric screen by means of brackets does make assembly the roman blind a little easier, there is still the time consuming step of mounting the roman bars to the suspension strings. It is possible to use rings or pins to mount the roman bars to the suspension cords; however, this still requires a significant amount of manual labor, particularly in order to mount the rings or pins to the cord. Therefore, an improved method of assembling roman blinds which speeds up the step of mounting the roman bars to the suspension cords is still required.

SUMMARY OF THE INVENTION

The present invention is a method of attaching a ring member to a cord using a minimum of steps. The method includes the steps of providing a hobble cord having opposite first and second ends, said cord having a plurality of loops formed thereon. Each loop formed on the cord has a loop opening. The first end of the cord is first threaded through the ring and the ring is then positioned to sit adjacent one of the loops between the loop and the first end of the hobble cord. The first end of the hobble cord is then threaded through the opening of the loop. The ring is then firmly secured to the cord by pulling the cord all the way through the loop. The steps may be repeated to attach more rings to the cord.

DESCRIPTION OF THE DRAWINGS

In the drawings like characters of reference indicate corresponding parts in the different figures.

DETAILED DESCRIPTION OF THE INVENTION

Figure 1:
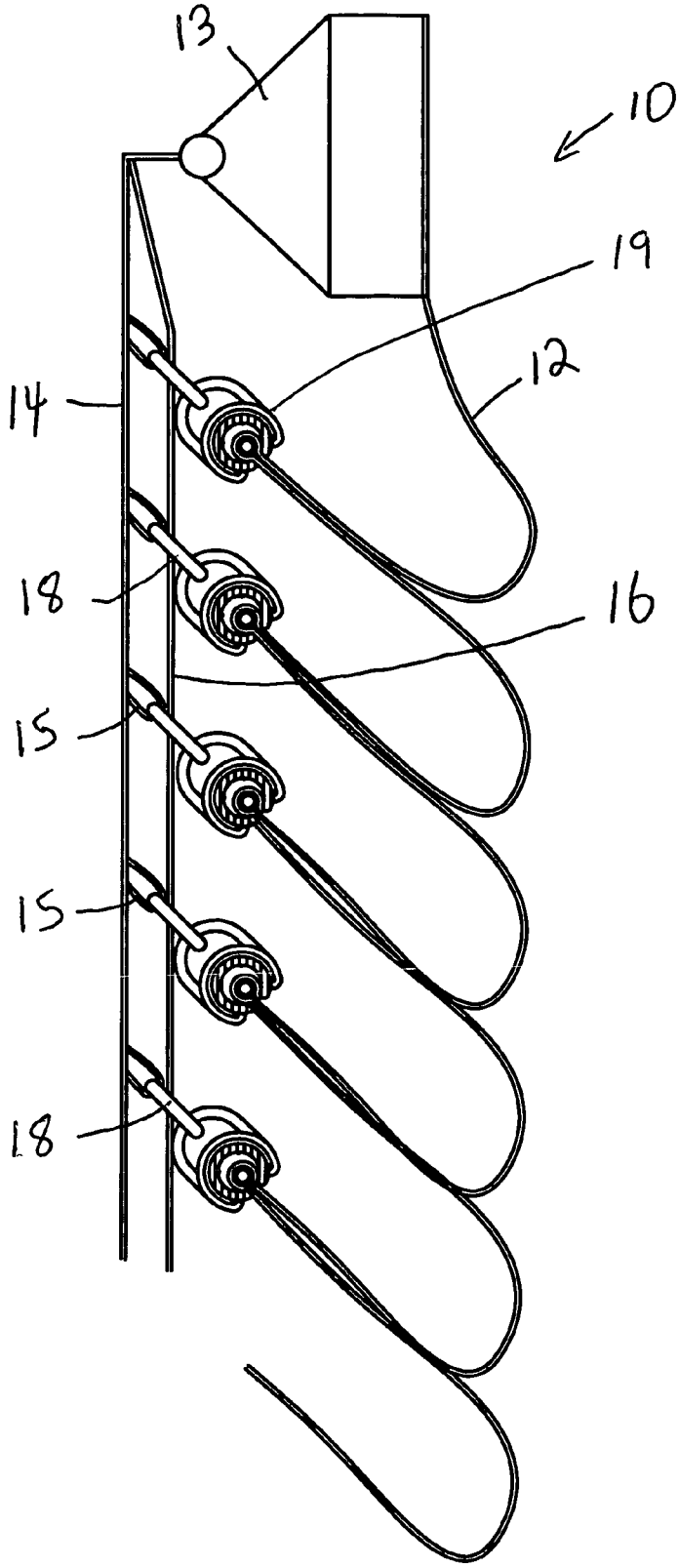
FIG. 1. is a side view of a Roman blind assembly.

Referring firstly to FIG. 1, a roman blind to be used with the present invention consists of a roman blind assembly, shown generally as item 10 which is made of several components, namely a fabric screen 12, a first pair of suspension chords 14 (referred to as loop cords or hobble cords) a second pair of suspension cords 16 (referred to as pull cords), and a plurality of mounting elements 19 for mounting the fabric screen to both the first and second pairs of suspension cords. The hobble cords each have a plurality of loops 15 spaced along the cords. A drawing mechanism 13 is provided to draw up the fabric screen by pulling up suspension cords 16. A plurality of mounting rings 18 secure the mounting elements 19 to loops 15.

Figure 2:
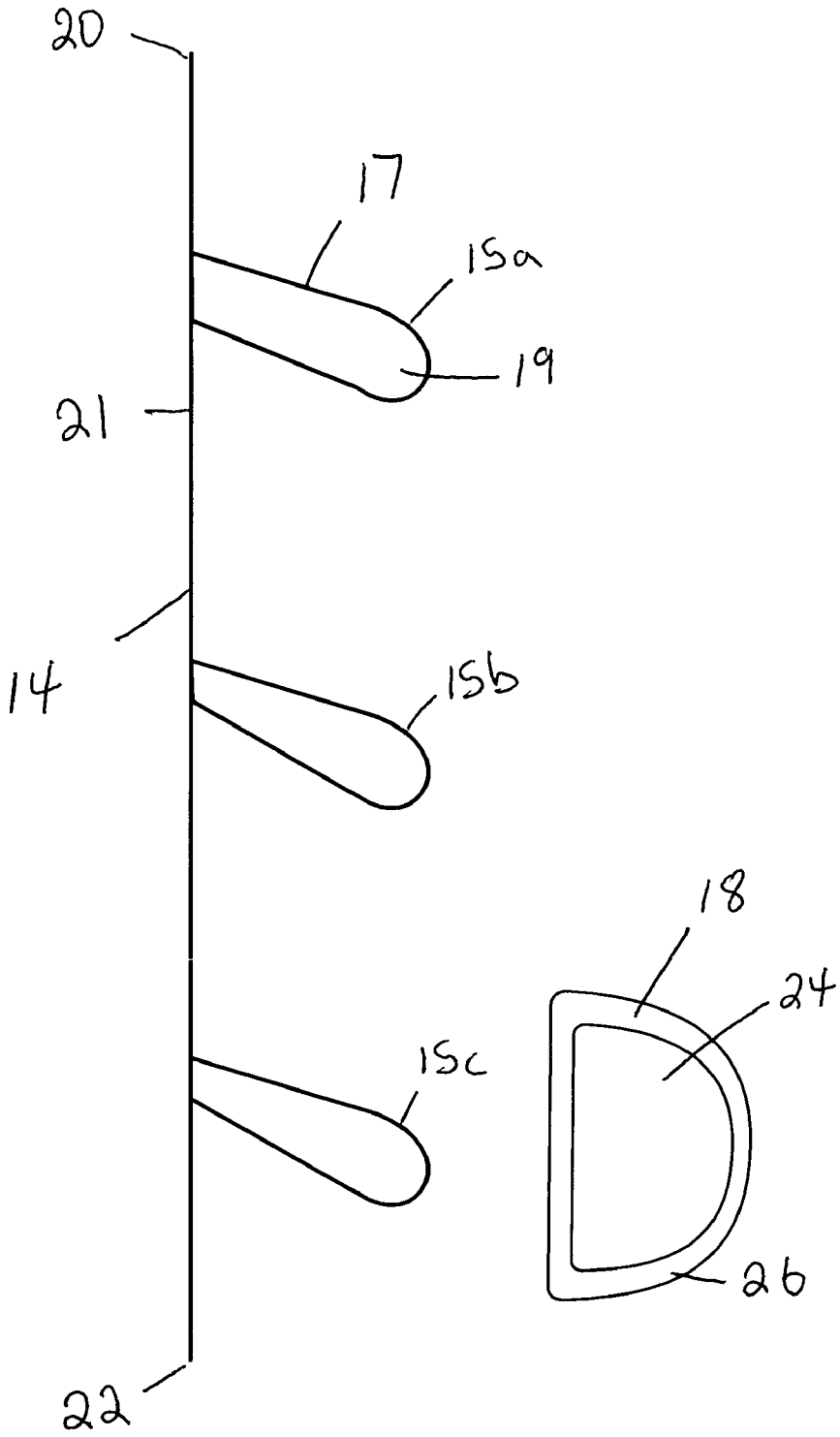
FIG. 2. is a side view of the loop cord portion of the present invention and the connector ring used to mount the roman blind to the cord.
Figure 3:
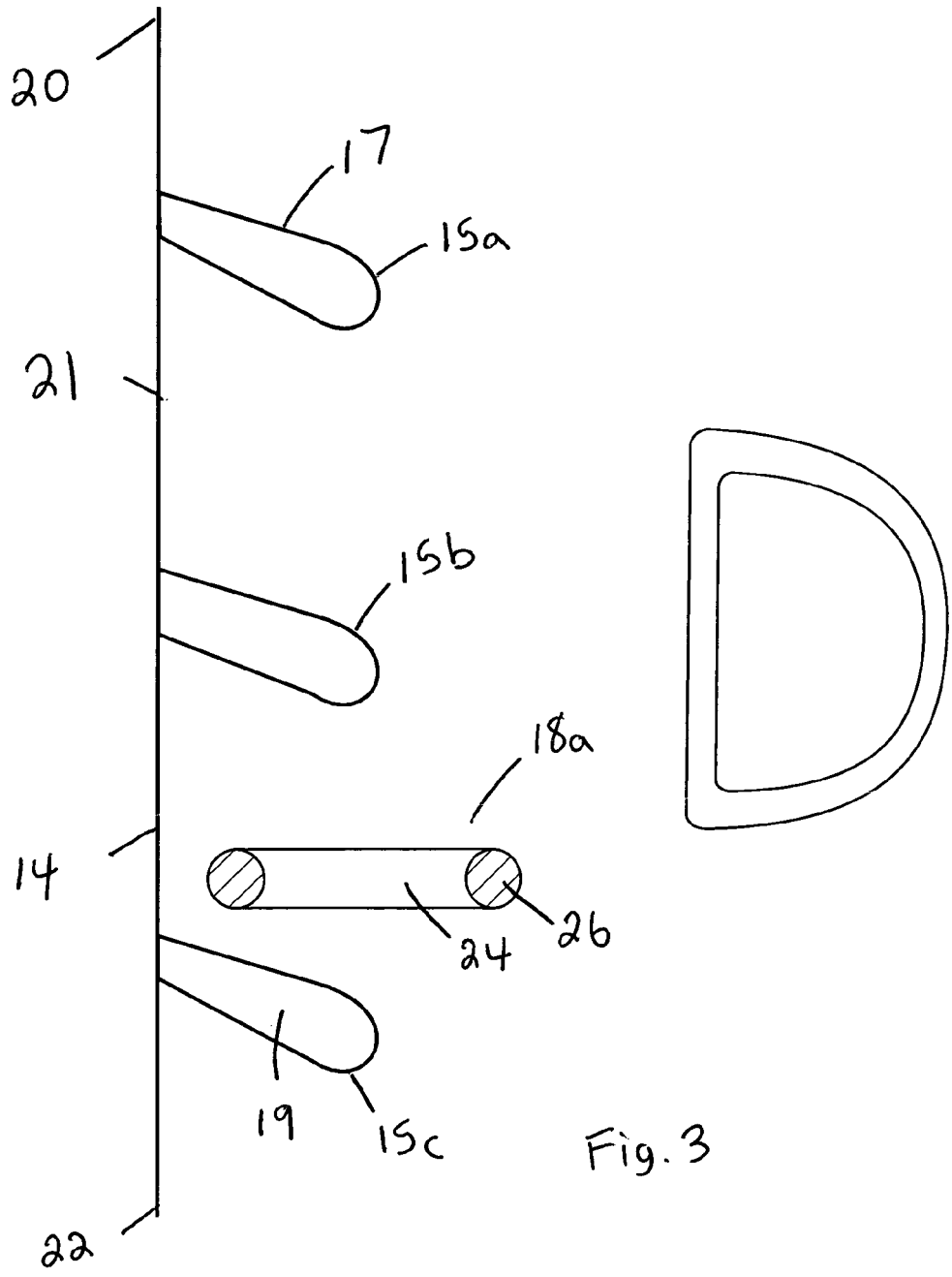
FIG. 3 is a side view of the loop cord and connecting ring illustrating a first step of the present invention.
Figure 4:
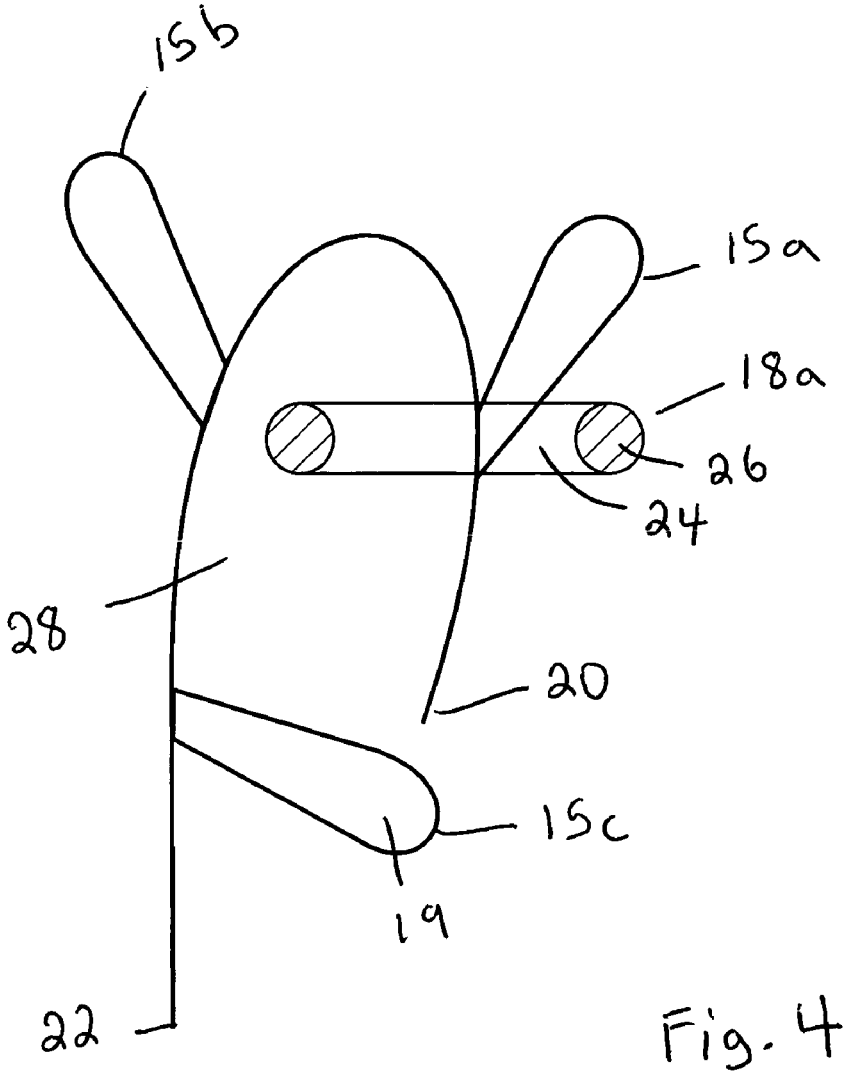
FIG. 4 is a side view of the loop cord and connecting ring illustrating the second step of the present invention.
Figure 5:
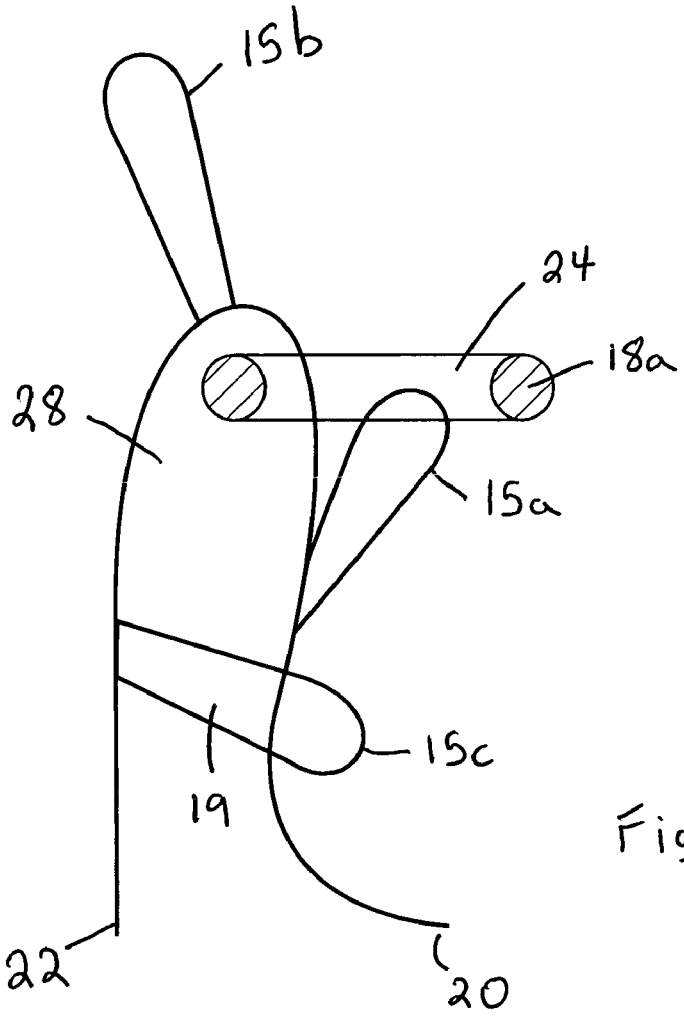
FIG. 5. is a side view of the loop cord and connecting ring illustrating the third step of the present invention.
Figure 6:
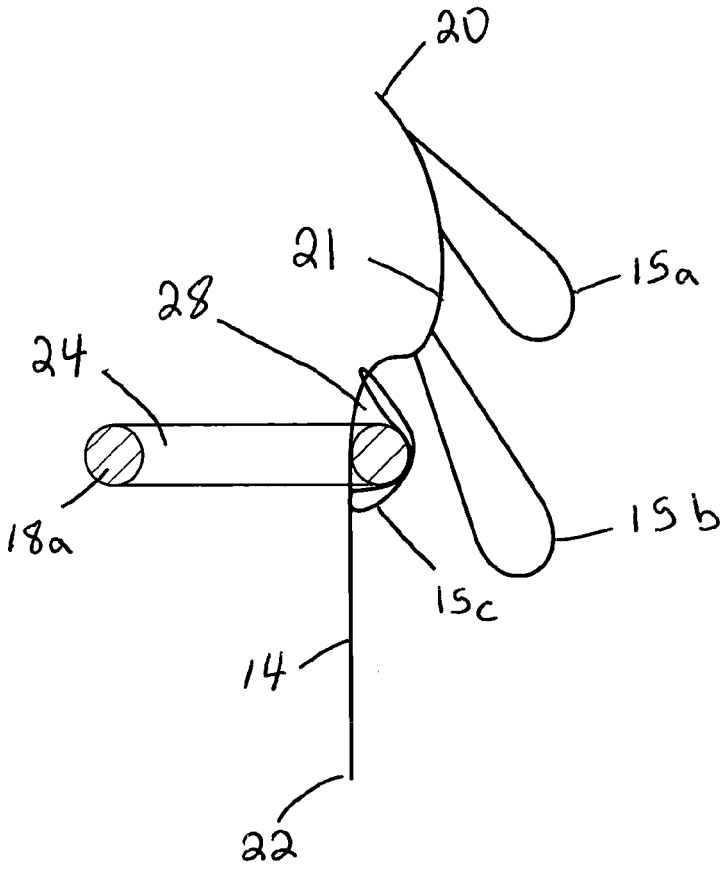
FIG. 6. is a side view of the loop cord and connecting ring illustrating how the cord is passed through a connecting loop.
Figure 7:
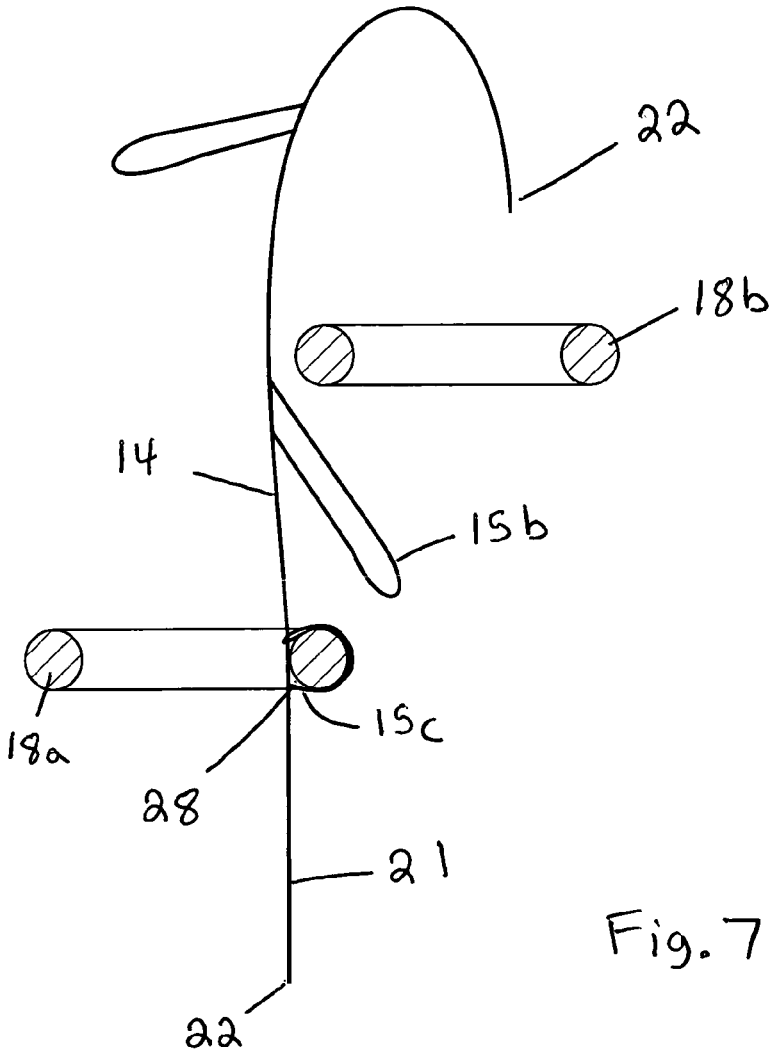
FIG. 7. is a side view of the loop cord and connecting ring illustrating how the ring is secured to the cord by tightening the cord through a loop in the cord.
Figure 8:
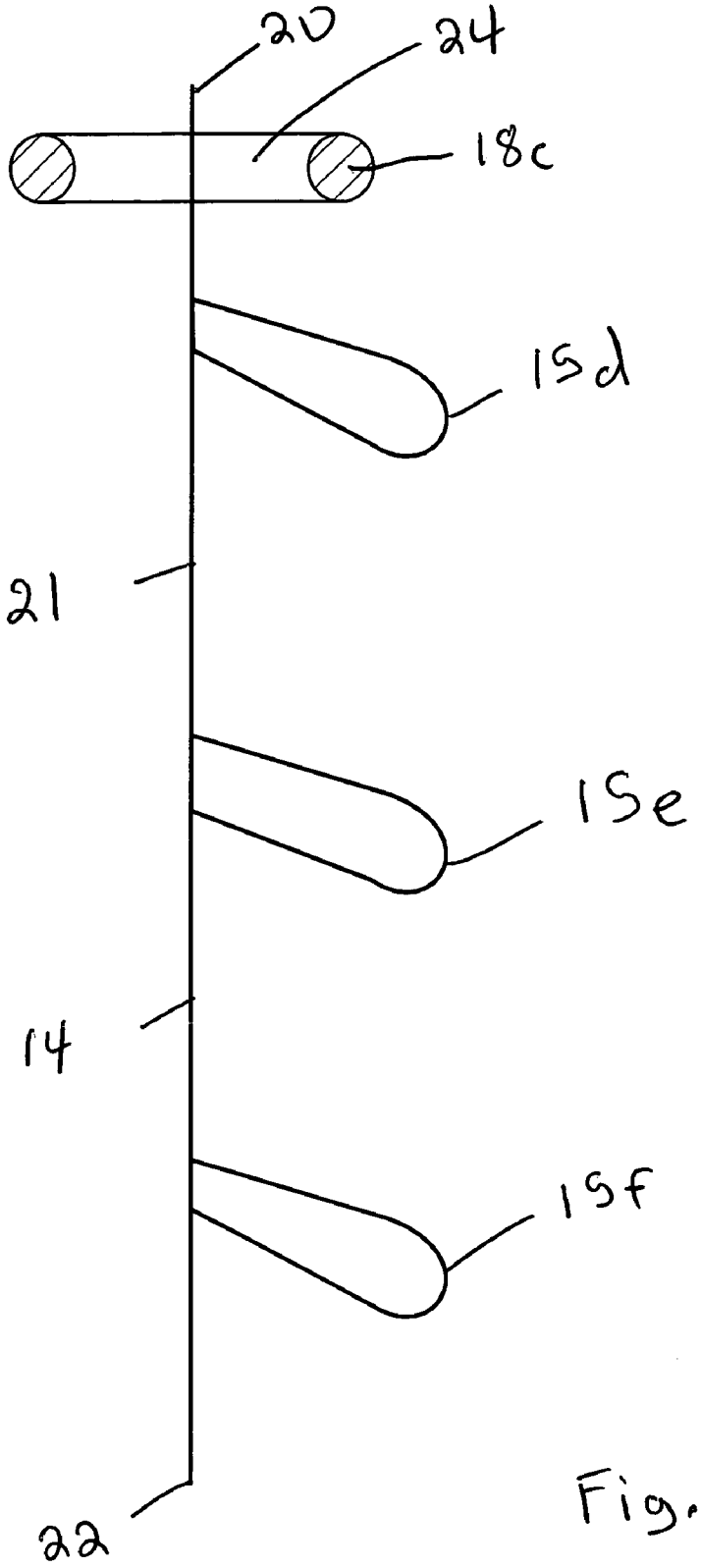
FIG. 8. is a side view of the loop cord and connecting ring illustrating how the ring may be threaded onto the loop cord.
Figure 9:
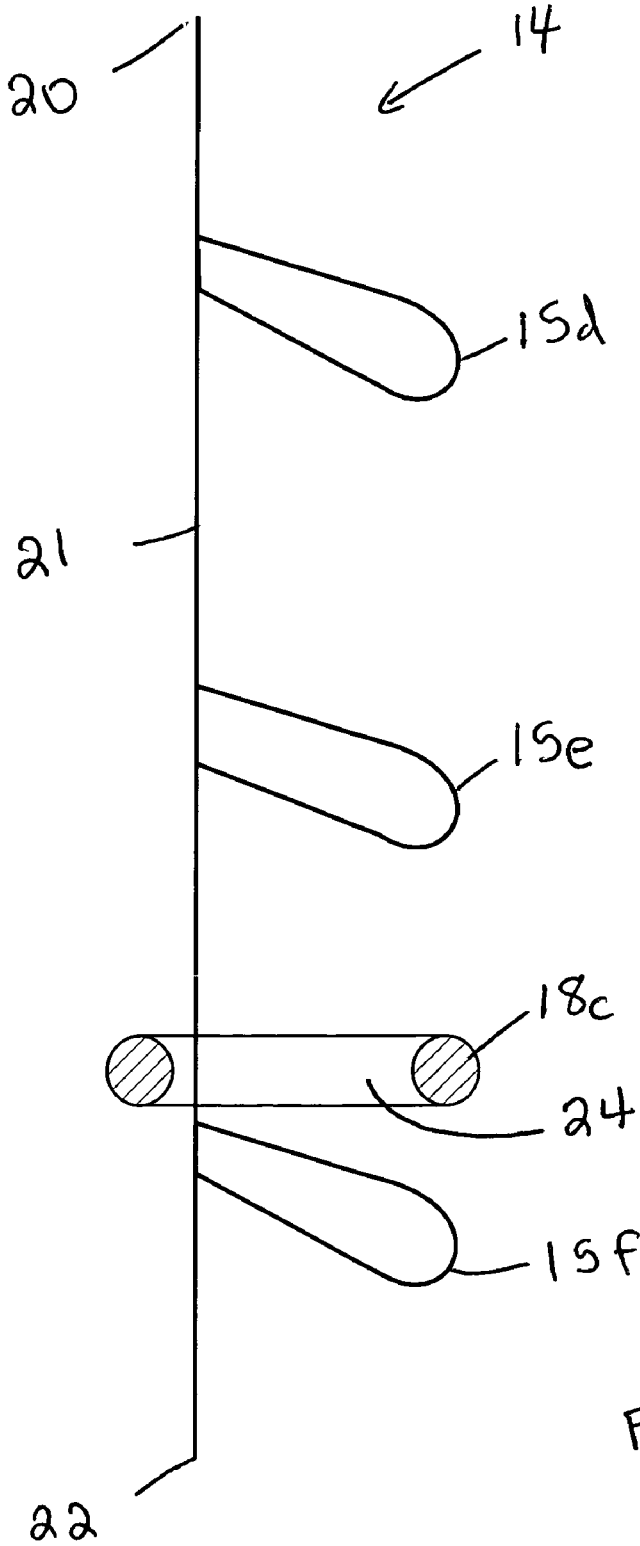
FIG. 9. is a side view of the loop cord and connecting ring illustrating how the ring may be placed into position for attachment to the cord.
Figure 10:
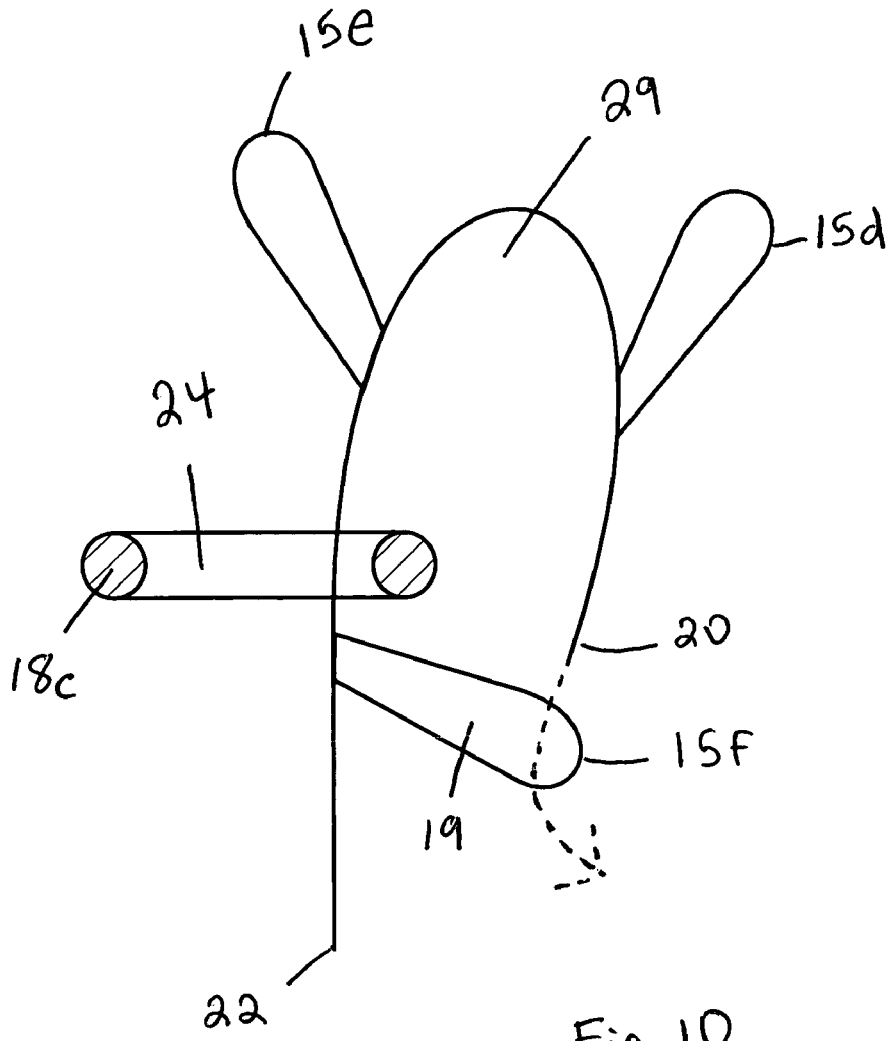
FIG. 10. is a side view of the loop cord and connecting ring illustrating how the cord is threaded back onto itself to secure the ring to the cord.
Figure 11:
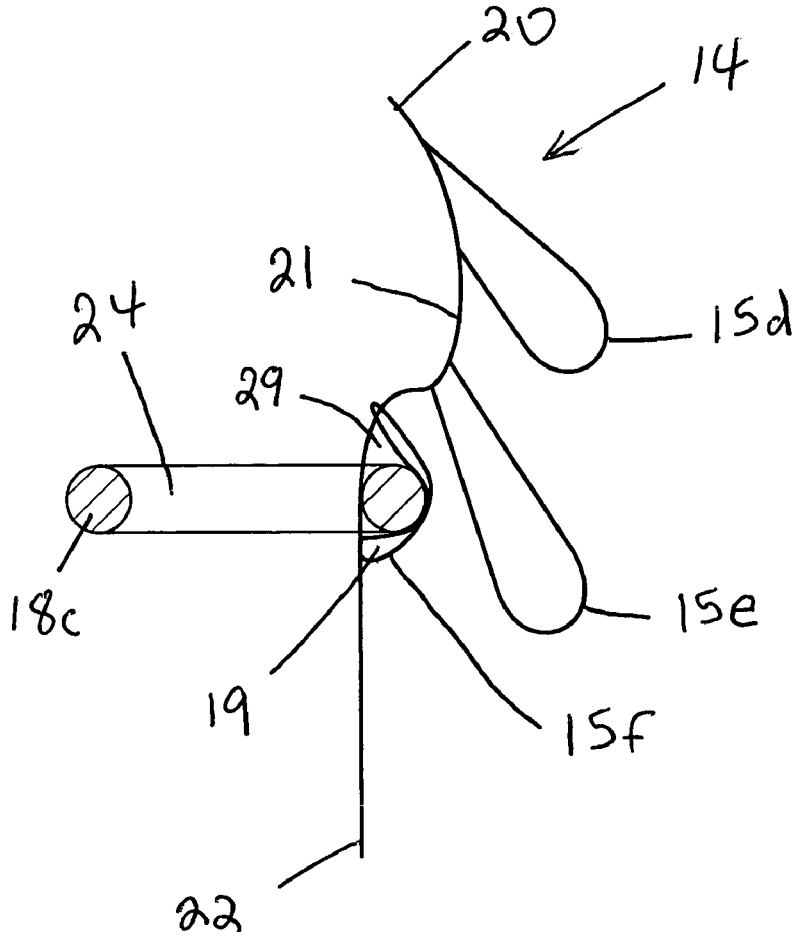
FIG. 11. is a side view of the loop cord and connecting ring illustrating how the cord tightened onto the ring to firmly secure it to the cord.

Referring now to FIG. 2, each hobble cord 14 consists of a flexible elongated cord 21 having opposite ends 20 and 22. Cord 21 may be made of any flexible material such as Nylon™ or the like. Loops 15 are formed on cord 21. Each loop 15 consists of a loop of cord 17 which forms an opening 19. The length of cord 17 is selected such that opening 19, when fully opened, has a diameter of approximately one centimeter or so. Preferably, cord 17 is integral with cord 21. Attachment rings 18 may be any ring like structure for attaching to cord 14. As it will be appreciated, ring 18 may be a split ring, but the method of the present invention is particularly well suited to solid or unbroken ring structures. Ring 18 will be a loop member 26 having an opening 24. The diameter of ring 18 is preferably no more than a few centimeters.

Referring now to FIGS. 3 to 7, the method of attaching rings 18 to loops 15 will now be discussed. To attach ring 18*a* to loop 15*c*, the ring is brought into close contact with loop 15*c* and positioned between the loop and end 20. Preferably, member 26 is brought so close to loop 15*c* that the member actually contacts loop 15*c* at a point adjacent cord 21. To lock ring 18*a* into place, end 20 of cord 14 is first passed through opening 24 of ring 18*a* and then trough opening 19 of loop 15*c*. As cord 14 is passed through opening 24 of ring 18*a* a loop 28 is formed with ring 18 positioned therein. The rest of cord 21 is pulled trough opening 19 of loop 15*c* to close loop 28 and tighten it onto ring 18*a*. As cord 21 is pulled through opening 19 of loop 15*c*, remaining loops 15*b* and 15*a* also pass through loop 15*c*. Tightening loop 28 onto ring 18*a* secures the ring to cord 14 such that the ring cannot be dislodged. After loop 28 is tightened onto ring 18*a*, the method may be repeated to secure ring 18*b* to cord 14 adjacent loop 15*b*. The method is repeated until all of the rings have been secured to the hobble cord.

It will be appreciated that it is quite simple to modify this method in order to speed up the process of attaching rings 18 to hobble cord 14. Referring now to FIGS. 8 through 11, ring 18*c* may be more quickly attached to cord 14 adjacent loop 15*f* by first threading the ring onto cord 14 by passing end 20 through opening 24 of the ring. The ring is then moved down cord 14 to a position adjacent loop 15*f* and between loop 15*f* and loop 15*e*. End 20 is then passed through opening 19 in loop 15*f* to form loop 29 which is then tightened onto ring 18*c* by pulling cord 21 fully through opening 19 of loop 15*f*. When ring 18*c* is secured, another ring may be secured using the same method.

The present method has several advantages over the prior art. Firstly, since the rings are attached to the hobble cord by threading the cord through the ring and then threading the cord through one of the loops of the hobble cord, it is possible to quickly attach the rings one at a time with a minimum of human labor. Also, the present method allows the use of unbroken solid rings as opposed to split rings or locking rings. It will be appreciated that split rings and/or locking rings require the additional steps of opening the rings and then locking the rings closed.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

What is claimed is:

1. A method of attaching a plurality of ring members to a cord comprising the steps of:

a) providing a cord having opposite first and second ends, said cord having a plurality of loops formed thereon, each loop having a loop opening, b) threading the first end of the cord through one of the rings and positioning the ring adjacent one of the loops, the ring being positioned between the loop and the first end, c) passing the first end of the cord through the opening of the loop and pulling the cord all the way through the loop to secure the ring onto the cord, d) threading the first end of the cord through the next ring and positioning the next ring adjacent the next loop which is immediately adjacent to the last loop to be secured with a ring, the next ring being positioned between the next loop and the first end, e) threading the first end of the cord through opening of the next loop and pulling the cord all the way through the loop to secure the next ring onto the cord, and f) repeating steps d and e above for the remaining rings.

2. The method of claim 1 wherein the cord comprises an elongated main cord having opposite ends and wherein each of the loops are formed from a separate loop cord attached to the main cord, the loop cord extending away from the main cord.

* * * * *